United States Patent [19]

Asano

[11] 4,166,338

[45] Sep. 4, 1979

[54] STEERING SYSTEM FOR RADIO OR WIRE CONTROLLED TRAVELING TOYS

[75] Inventor: Kiyoji Asano, Tokyo, Japan

[73] Assignee: Shinsei Kogyo Co., Ltd., Japan

[21] Appl. No.: 874,783

[22] Filed: Feb. 3, 1978

[51] Int. Cl.[2] ..... A63H 30/02

[52] U.S. Cl. ..... 46/253; 46/254

[58] Field of Search ..... 46/210, 253, 254

[56] References Cited

U.S. PATENT DOCUMENTS

| | | | |
|---|---|---|---|
| 3,199,249 | 8/1965 | Carver et al. | 46/253 |
| 3,782,031 | 1/1974 | Byron | 46/254 |
| 3,878,521 | 4/1975 | Licitis et al. | 46/254 |
| 4,112,615 | 9/1978 | Ishimoto | 46/254 |

*Primary Examiner*—Louis G. Mancene
*Assistant Examiner*—Robert F. Cutting
*Attorney, Agent, or Firm*—Staas & Halsey

[57] ABSTRACT

A steering system for radio or wire controlled traveling toys such as model cars having steerable wheels connected to a steering bar. Mechanism is in turn connected to the steering bar for actuation thereof and includes a pair of rack members connection to respective ends of the mechanism. A single electric drive motor provides the propulsion for the toy car through an axle and differential acting drive wheels and is in turn coupled through a slip gear to planetary gear drive clutches which may be alternately locked by means of a pair of solenoids and associated pawls. Output gears driven by the drive clutches in turn effect movement of one or the other of the rack members to steer the car. A centering spring for the steering mechanism returns the steering to straight ahead automatically once the turn energization is completed. The slip gear also will prevent damage to the drive and steering components once steering limits are reached.

12 Claims, 5 Drawing Figures

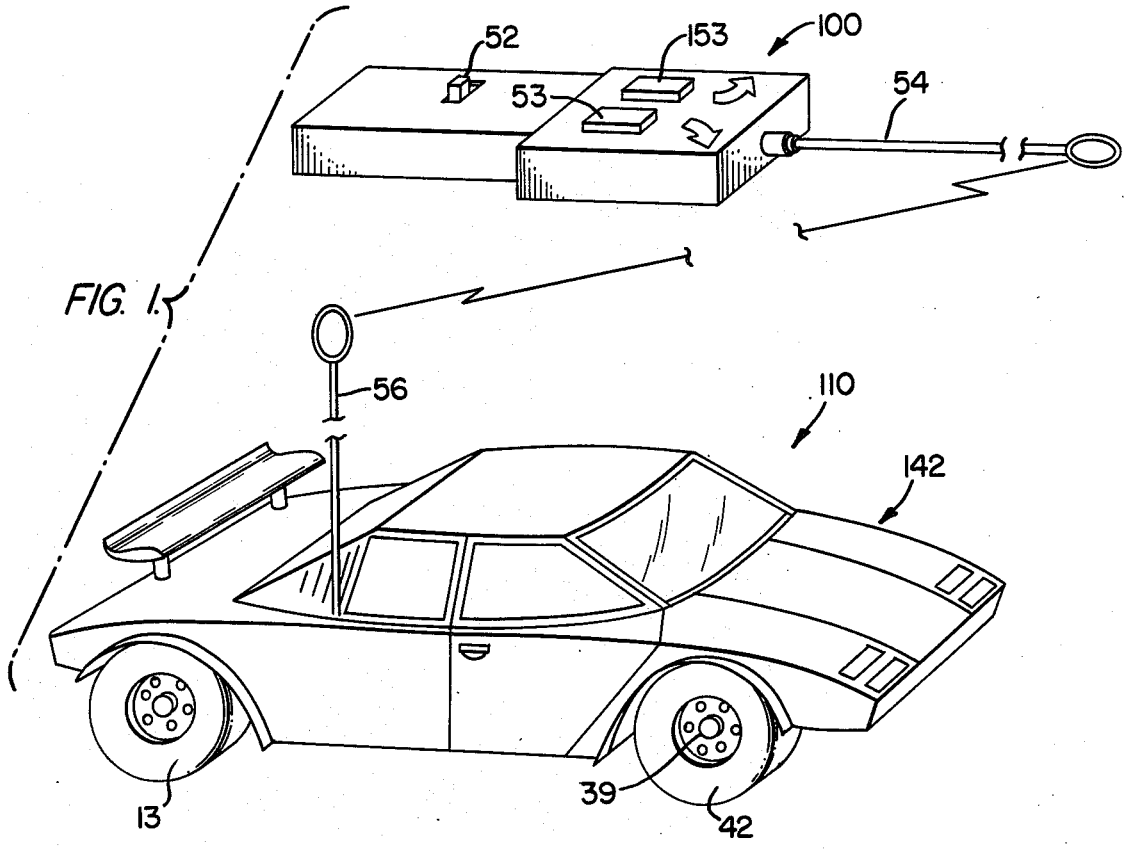
FIG. 3.
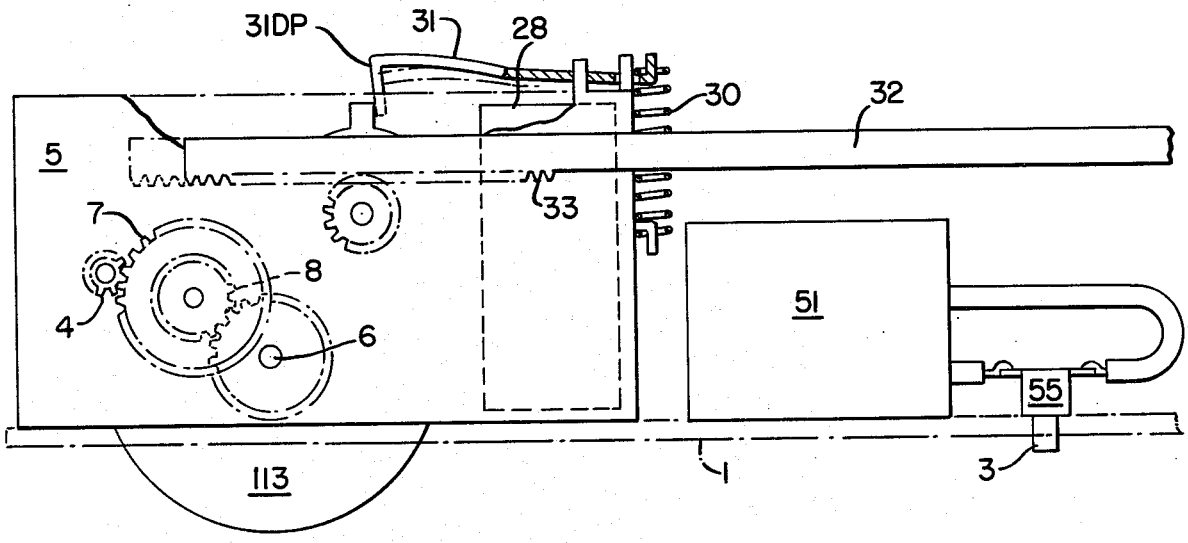

STEERING SYSTEM FOR RADIO OR WIRE CONTROLLED TRAVELING TOYS

BACKGROUND OF THE INVENTION

1. Field of the Invention

This invention relates generally to a new and novel steering system for use with radio or wire controlled traveling toys such as model automobiles.

2. Description of the Prior Art

Known prior art devices for steering model automobiles and the like normally require complicated servo motor mechanisms which are expensive, inaccurate, and complicated. Known type control mechanisms do not provide for simple, yet positive solenoid actuated steering.

Another problem with known type steering mechanisms for traveling toys is that they do not automatically return to a straight line or no steering position when the mechanism is not being actuated.

SUMMARY OF THE INVENTION

An object of the present invention is to provide a simple, yet positive acting steering system for model automobiles of the traveling toy type as normally controlled remotely by a radio transmitter, or a signal coupling wire connected thereto.

Another object of the present invention is to provide a steering system utilizing simple solenoid or electromagnet actuation thereof together with a pair of planetary gear clutch drives connected with rack members for the steering mechanism to actuate same in one direction or the other.

A further object is to provide a pair of racks actuated by clutchable planetary drives from a single electric motor which also drives the propulsion wheels for the vehicle. A suitable slip coupling prevents damage to the structure when the steering mechanism reaches its turning limits in either direction.

The steering system of the present invention includes a pair of planetary gear clutch devices driven in common from a central friction slip coupling drive gear driven from the propulsion axle of the vehicle. A single electric motor is coupled to the propulsion axle for driving same. Vehicle wheels are mounted upon the propulsion axle and at least one positively affixed thereto. Preferably only one of the drive wheels is positively connected to the propulsion axle, and the other is freely rotatable thereon to provide a differential drive function for the vehicle. Electromagnets associated with the planetary gear clutch mechanisms provide the braking or stopping function for one or the other of cage ratchet wheels for the planetary pinion gears as associated with the output gears which in turn drive rack members connected to the steering mechanism of the vehicle. When one electromagnet or the other is actuated, the associated planetary gear cage ratchet wheel will be locked in order to provide drive therethrough to the associated rack member, which in turn actuates the steering linkage to turn the steering wheels of the vehicle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a radio controlled model automobile using the steering system of this invention.

FIG. 3 is a side elevational view of the drive end of the frame of FIG. 2.

DESCRIPTION OF THE PREFERRED EMBODIMENT

Figure 2:
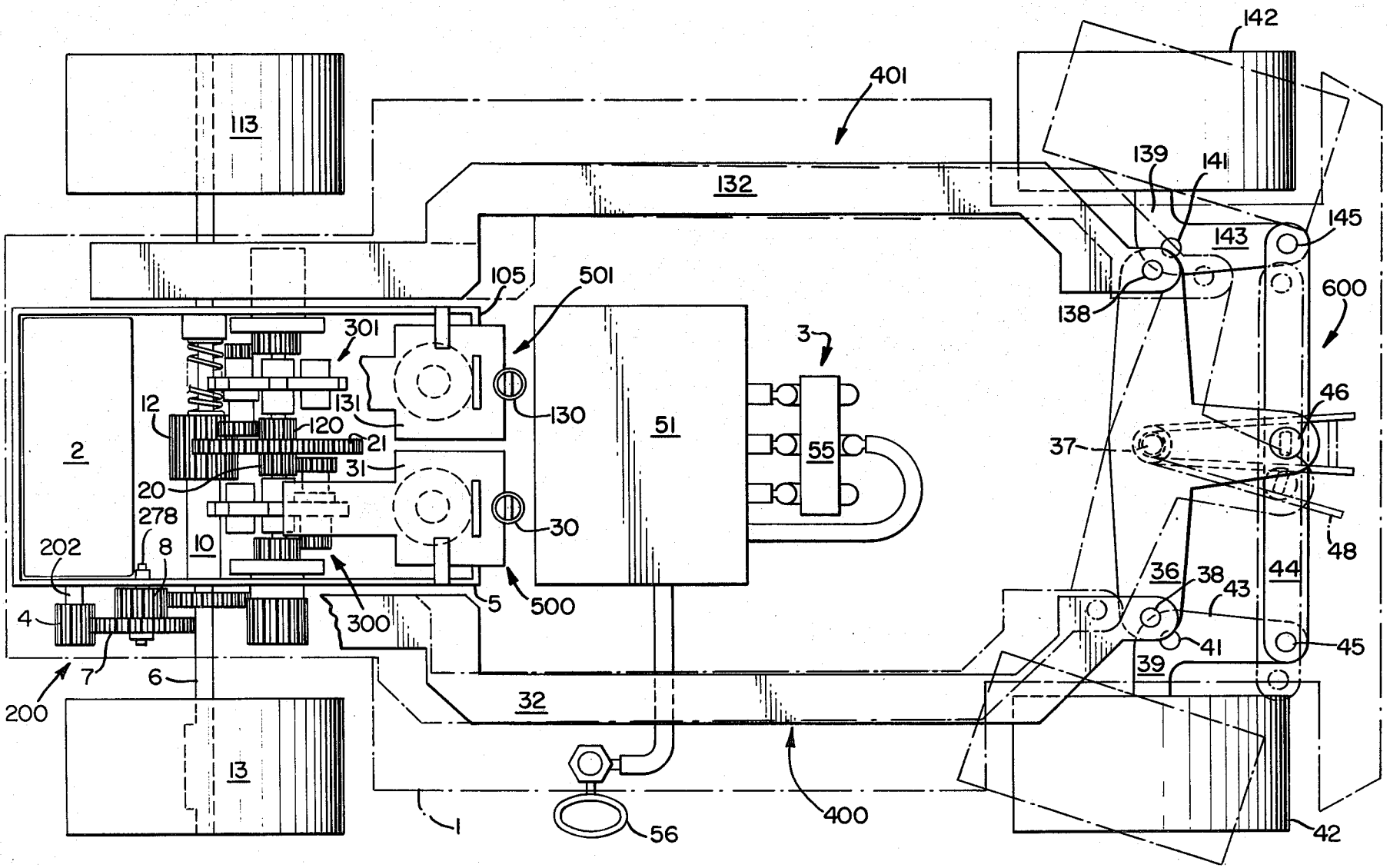
FIG. 2 is a top plan view of the model automobile chassis frame with the main component elements of the drive and steering system being shown.

Referring to FIG. 1 of the drawings, reference numeral 100 indicates in general the radio control transmitter for operating a radio controlled model automobile incorporating the propulsion drive, steering system and actuating mechanism of this invention. Reference numeral 110 indicates the model automobile while a drive wheel 13 and steerable wheels 42 and 142 are also indicated. Obviously, any desired body styling may be used for the vehicle. A receiving antenna 56 is provided for reception of the radio control signals and for feeding same to the model car internal radio receiver. The transmitter 50 is of conventional type and is provided with a "start-stop" switch button 52, a "turn to right" button 53, a "turn to left" button 153, and a transmitting antenna 54. Known type radio transmitter and receiver circuits may be incorporated in these respective devices.

Now looking at FIGS. 2, 3 and 4, the various component units of this invention will be described in detail. A chassis 1 supports side frames 5, 105 vertically therefrom. Reference numeral 200 indicates in general the driving section of this device. This includes an electrical drive motor 2 having an output shaft 202 for driving an output pinion 4. Output pinion 4 in turn drives integral intermediate reduction gears 7 and 8, freely rotatably supported on an axle stub 278 mounted from the side frame 5. A propulsion axle 6 is also suitably supported for rotation in aligned apertures 206 provided in side frames 5 and 105. Wheels 13 and 113 are suitably mounted on the propulsion axle 6. Preferably only one of these wheels is positively affixed to axle 6 by any conventional structure, such as a set screw or the like, while the other wheel is freely rotatable on the propulsion axle. The purpose of this is to provide the function of a differential between the two wheels, much in the manner of the differential of conventional automobile vehicles.

In operation, the single electrical motor 2 is suitably energized from self contained batteries within the vehicle, not shown, as connected thereto under the control of the radio receiver 51. The radio receiver 51 picks up the transmitted signals through the receiving antenna 56 to provide appropriate steering control through the mechanism described herein. Reference arrow 3 indicates an "on-off" switch for the vehicle itself, while associated starting and stopping circuitry is housed within the switch housing enclosure 55.

Suitably mounted upon the propulsion axle 6 to provide power for operation of the steering mechanism is a slip gear 12. The slip gear 12 is freely rotatable on the propulsion axle 6, but constrained between tubular members 10 and 11 which are affixed to the propulsion axle 6 by any suitable key 61 or set screw 62 structure. A spring 11 provides a friction drive between the end thereof which engages with the slip gear 12 and the other face of slip gear 12 in engagement with the corresponding end of tubular member 10. Thus, in normal operation the slip gear 12 will be friction driven whenever the propulsion axle 6 is rotating. However, if positive resistance against the slip gear 12 occurs, such as when the steering mechanism reaches one of the end limits of a respective left or right turn, the gear will slip to prevent any damage to the steering mechanism.

A pair of planetary gear clutch mechanisms 300 and 301 are provided for coupling the driving force from slip gear 12 to the respective ends of steering T 36. This is accomplished through the rack devices 400 and 401. These rack devices include elongated members 32 and 132 mounted externally on the respective right frame 5 and left frame 105. The driven end of each respective rack member 32, 132 is provided with teeth 33 and 133 on the lower portion thereof. These teeth are in respective engagement with pinions 34 and 134 on the respective side frames 5 and 105.

Electromagnetic actuating mechanism 500 and 501 are suitably connected by wiring (not shown) to the radio receiver 51 for energization thereof from the self contained vehicle batteries. When properly energized they effect the turning and steering of the vehicle. Each electromagnetic mechanism includes solenoid structure supporting pivotally mounted pawl plates 31, 131, having depending projections at the outer ends thereof 31DP, 131DP. Retraction springs 30 and 130 are suitably mounted on the other end of the pivotal pawl plates for suitable retraction thereof. Electromagnet coils 28 and 128 when suitably energized provide the actuation for the pawl plates.

Figure 4:
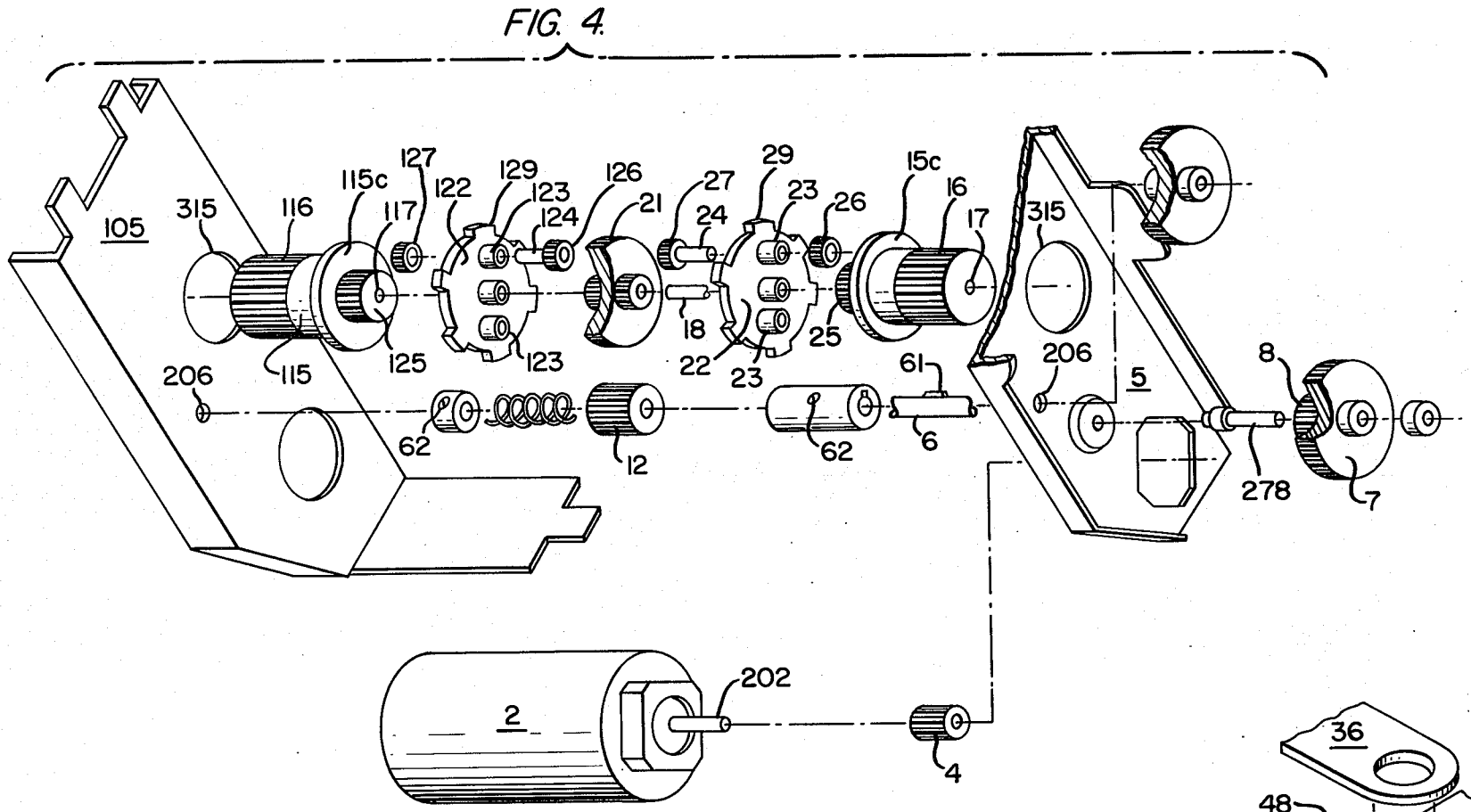
FIG. 4 is an exploded perspective view of the propulsion drive and the planetary gear clutching structure of this invention.

The planetary gear clutch mechanisms 300 and 301 include the following structure, as best seen in FIGS. 2 and 4. The main input to the pair of planetary gear clutch sections is the main input gear 21 which is suitably driven from the slip gear 12. The planetary main input gear 21 has integral sun pinions 20, 120 on the respective sides thereof. Mounted within large apertures 315 in the side wall frames 5, 105 are bearing portions 15 and 115, integral with the rack drive gears 16 and 116. Collars 15C and 115C are also integral with the bearing portions for forming a thrust surface against the inner side of the frames 5, 105. The rack drive gears 16 and 116 also have integral with the bearing and collar portions 15, 15C and 115, 115C, smaller gears 25 and 125. An auxiliary shaft 18 is mounted within the central apertures 17 and 117 of these support bearings/gears as mounted within the frame sides 5, 105. Centrally and freely rotatably mounted on the auxiliary shaft 18 is the planetary main input gear 21 with the integral sun pinion gears 20, 120. Mounted on either side of the input sun wheel are planetary gear cage ratchet wheels 22 and 122. These ratchet wheels are freely rotatably mounted on the auxiliary shaft 18 with one on either side of the input gear 21. Off set bosses 23 and 123 are respectively provided, at least one per each planetary gear cage ratchet wheel, but preferably two or more, for rotatably supporting on short shafts 24, 124 the planet gears 26, 27, and 126, 127. Gears 26 and 27 are both fixed on shaft 24 which is mounted for free rotation in bearing boss 23. Likewise, gears 126, 127 are fixed on shaft 124 which is freely rotatable in bearing boss 123. The planetary gear ratchet wheels 22 and 122 are provided with outwardly extending projections 29 and 129 for engagement and braking by the projecting tips 31DP and 131DP of pawl plates 31 and 131.

Thus, as can be readily visualized by looking at the perspective view of FIG. 4, when the input gear 21 is being driven and the sun pinion gears 20 and 120 are in turn being rotated, if one or the other of the planetary gear ratchet wheels 22 or 122 is locked by means of the associated solenoid 28, 128 being energized to engage the pawl plate tip 31DP or 131DP with the projection 29 or 129 of the ratchet wheel, it will be stopped. With ratchet wheel 22 or 122 locked against rotation, a transfer of rotation occurs through the appropriate planetary gear set 26, 27 or 126, 127 to the output gear 25 or 125. Thus the associated rack pinion 34 or 134 will be correspondingly driven, as determined by the appropriate electromagnet 28 or 128 being energized, to effect longitudinal movement of one rack member 32, or 132 to cause the steering mechanism to turn right or left.

Figure 5:
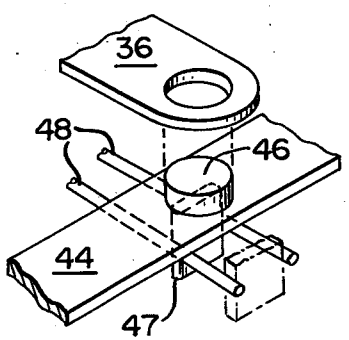
FIG. 5 is a fragmentary, perspective view of the steering linkage coupling and steering centering structure.

Looking at the other end of the vehicle chassis, the steering mechanism is indicated in general by reference numeral 600. Mounted on the upper front of chassis 1 is a T-shaped steering bar 36. The steering bar 36 is pivotally mounted on chassis 1 by means of a center pivot shaft 37. The outer ends of the horizontal portion of the steering bar 36 are connected to the ends of the rack members 32 and 132 by means of pivot pins 38 and 138, to form respective pivot pin joints. The road engaging steering wheels 42 and 142 are mounted for free rotation on a pair of axles 39 and 139 formed on L members 43 and 143. These L members are in turn pivotally mounted on chassis 1 by pivot pins 41 and 141. The other end of the L members 43 and 143 are connected by a link 44. Pivot pins 45 and 145 make this connection. Another pivot pin 46 connects the stem of the steering T bar 36 and the line 44. A downwardly extending projection 47 on the link 44 (FIG. 5) engages with a torsion spring 48 for the purpose of returning the steering mechanism to the central straight ahead position. Both the steering wheels 42 and 142 are freely rotatably mounted on the axles 39 and 139 and retained thereon in a conventional manner. When one rack member 32 or the other 132, is moved longitudinally it will cause the steering T bar 36 to pivot about center pivot 37, and thus effect steering of the vehicle.

The operation of the device is basically as follows. When the "start-stop" button 52 of the transmitter is energized, the on-off switch 3 of the vehicle having already been turned on, the motor 2 of the vehicle will become energized through the radio receiver controlled switch mechanism. The rotation of the motor output shaft will in turn be transmitted through the pinion 4, intermediate gears 7 and 8, and spur gear 9 to rotate the propulsion shaft 6 and the appropriate fixed one of the drive wheels 13 and 113. Thus the vehicle begins to move.

If the "turn to right" button 53 is pushed, the transmitter will send the appropriate signals to the vehicle receiver 51, and the right turn electromagnet 28 will be energized to draw pawl plate 31 downwardly. When the projecting tip 31 DP engages with one of the projections 29 on the planetary gear cage ratchet wheel 22, this ratchet wheel will be locked in position thus stopping the free rotation thereof on the auxiliary shaft 18, to effect the rotation of planetary gear 27, axle shaft 24 and in turn planetary gear 26. This will in turn drive output gear 25 and rack gear 34 to move the rack 32 to the left as seen in FIGS. 2, 3 and thereby rotate the steering bar 36 clockwise as seen in FIG. 2 to turn the vehicle to the right.

When the maximum rotatable angle of the steering bar 36 is reached, i.e., the steering mechanism reaches the limit of turning movement, the train of gears of the clutch structure 300 will be blocked and thus stop rotating, and as a result the driving axle continues to rotate within the retained slip gear 12. Simultaneously, the torsion spring 38 relieves the turn control signal through the radio receiver of its operating position by structure, not shown, to de-energize the turn control. The spring 48 then centers the steering mechanism once again. A turn to left signal effects the appropriate energization of solenoid 128 to block the planetary gear ratchet wheel 122 in the same manner as already described to effect a left turn of the vehicle.

In summary, the steering system of this invention includes a pair of planetary gear clutch sections each adapted to assume a coupling or uncoupling drive according to the position of solenoid actuated pawls. This use of solenoids instead of servo motors greatly simplifies the steering system, and also is much less expensive. While many of the electrical wiring connections have been omitted from the drawing figures for the purpose of clarity, such wiring is of course provided in the conventional manner for proper connection of the electrical components.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A steering mechanism for remote controlled traveling toys such as model cars and the like comprising: a main support chassis, drive means mounted on one end of said support chassis for effecting propulsion movement thereof, steering means mounted at the other end of said support chassis for effecting steering thereof, a pair of planetary gear clutch mechanisms mounted on said support chassis and arranged to effect a steering force from said drive means to said steering means, and solenoid means associated therewith to cause said steering force to occur.

2. The structure as set forth in claim 1, wherein each one of said pair of planetary gear clutch mechanisms includes a central input sun gear having double sun gear portions thereto, and planetary gear ratchet wheel structure mounted on each side of said central input gear, and means thereon arranged for stopping engagement by the aforesaid solenoid means.

3. The structure as set forth in claim 1, wherein the steering means includes a pivotally mounted T member, the respective ends of the cross member of said T being connected to longitudinally movable rack members supported on the said support chassis, and said rack members being arranged for actuation by the respective outputs of said planetary gear clutch mechanisms.

4. The structure as set forth in claim 1, wherein the aforesaid drive means includes an energizable electric motor, reduction gearing connected between said electric motor output and a propulsion axle mounted for rotation upon said support chassis, an input gear affixed to said propulsion axle and in engagement with said reduction gearing, and at least one propulsion wheel affixed to said propulsion axle.

5. The structure as set forth in claim 4, wherein each of said pair of planetary gear clutch mechanisms has a drive input which includes a friction slip gear mounted upon said propulsion axle, an input sun gear in engagement with said input friction slip gear, said sun gear mounted on an auxiliary shaft parallel to said propulsion axle, a pair of planetary gear ratchet wheels mounted on either side of said input sun gear on said auxiliary shaft for free rotation therearound, a plurality of planetary gears mounted for rotation on each of said planetary gear ratchet wheels, and output pinion gears rotatably associated with said planetary gears and rotatably mounted with said auxiliary shaft.

6. The structure as set forth in claim 5, wherein said steering means mounted on the other end of said support chassis includes rotatably mounted steering wheels supported by L shaped axle members, a connecting link between ends of said L shaped axle members, a steering member of T shaped configuration pivotally and drivingly engaged with said link, opposite ends of said T shaped steering member being connected to longitudinally movable rack members, said longitudinally movable rack members having tooth rack portions along the underside thereof for engagement with the output pinion gears of said planetary drive mechanisms.

7. A steering system for model automoblies comprising: an elongated vehicle chassis, a propulsion drive mounted on one end thereof, a steering structure mounted at the other end thereof, planetary gear mechanism, and rack coupling means connecting the propulsion drive through the planetary gear mechanism with the steering structure for appropriate control thereof when energized under the control of an operator.

8. The structure as set forth in claim 7, wherein said coupling means includes rack members longitudinally movable along the chassis for transferring force from the planetary gear mechanism to the steering structure.

9. The structure as set forth in claim 8, wherein the planetary gear mechanism includes two normally rotatable planetary gear supporting ratchet wheels, and a pair of associated electromagnets are arranged to stop said normal rotation of one ratchet wheel or the other when energized.

10. The structure as set forth in claim 9, together with a radio receiver mounted within said model automobile for connecting appropriate battery energy to the propulsion drive when controlled to do so by an external transmitter radio signal.

11. The structure as set forth in claim 10, wherein the propulsion drive includes a single electric motor arranged to drive on axle supporting propulsion wheels on the vehicle, only one of said propulsion wheels being positively driven and the other being freely rotatable on the axle to provide a differential drive action for the vehicle, and a slip gear frictionally driven from said axle for providing an input to the planetary gear mechanism for said steering structure.

12. The structure as set forth in claim 11, wherein the frictionally driven slip gear is mounted between two tubular members mounted on the propulsion axle of the model automobile, and a spring is associated with at least one of said tubular members for biasing the slip gear into friction engagement with the other tubular member.

* * * * *